US005368490A

United States Patent [19]

McKissick

[11] Patent Number: 5,368,490

[45] Date of Patent: Nov. 29, 1994

[54] SWITCHABLE POWER OUTLET

[76] Inventor: Todd A. McKissick, 6283 S. Miller St., Littleton, Colo. 80127

[21] Appl. No.: 11,717

[22] Filed: Feb. 1, 1993

[51] Int. Cl.[5] ..... H01R 29/00

[52] U.S. Cl. ..... 439/52; 200/51.05

[58] Field of Search ..... 439/188, 189, 52, 170, 439/218, 221; 200/51.02, 51.03, 51.05, 51.07

[56] References Cited

U.S. PATENT DOCUMENTS 2,214,065 9/1940 Pennock et al. ..... 439/516

5,098,307 3/1992 Francisco ..... 439/188

*Primary Examiner*—Neil Abrams

*Attorney, Agent, or Firm*—John P. Halvonik

[57] ABSTRACT

The invention is an improved electrical outlet of the kind normally found in household walls. These outlets usually have two slotted, prong holes, and a circular grounding hole. The improvement lies is providing the outlet with the ability to be set into one of three possible modes-normal, inoperable and "switched." In the normal mode the outlet functions in the normal way. In the inoperable mode the outlet provides no power at all. In the switched mode, the outlet may be operable or inoperable depending on the condition of an external switch located somewhere else in the home or building. The mode may be set by inserting a specially shaped key designed to fit into the prong holes of the outlet to thereby turn a special pivoting assembly located between the contact points and the back wall of the outlet assembly. The pivoting assembly may be pivoted in the manner of a lever resting in a fulcrum in one of three directions depending on which portion of the special key is depressed. Pivoting the assembly in a certain direction changes the power of the "hot" prong either grounding it, making it hot or connecting to the "switched" power supply.

2 Claims, 2 Drawing Sheets

SWITCHABLE POWER OUTLET

FIELD OF INVENTION

1. Background of the Invention

The invention relates to the field of power outlets, especially those found in the home or office, and in particular, to a power outlet whose power supply may be hanged to one of three modes, normal, inoperable or "switched." The invention also relates to a specially shaped key which may be inserted into the prong holes of the power outlet in order to activate the outlet into one of the three modes.

2. Description of the Prior Art

There are no known devices that applicant is aware of that allow one to change the "mode of operation" of an electrical wall outlet box. Mode of operation is understood to mean, in this case, where the power in the outlet is 1) controlled by a switch or 2) whether it is altogether inoperable or, 3) where the outlet functions in the normal manner.

SUMMARY OF THE INVENTION

The invention is a wall outlet, electrical power, receptacle. The receptacle has at least two prong recesses, designated a hot prong and a neutral prong. This is standard construction for most household receptacles. Nowadays, there is usually a third recess-known as the ground which insures safety. The receptacle does not require the ground recess in order to operate in the applicant's system. The novelty resides in the fact that the applicants receptacle may be switched by the user into one of three modes depending on the user's preference.

The three modes are: "Normal," "Inoperable," or "Switched" modes. "Inoperable" means of course that the receptacle does not function at all, and "Normal" means the receptacle function in the normal way. In the "Switched" mode, the power source for the outlet is controlled by the condition of an external switch. This external switch may be wall mounted or otherwise placed where the user can operate it to either activate or deactivate the wall outlet.

The novel structure of the receptacle includes a pivoting assembly located behind the contact points of the recesses on the front of the outlet. The assembly pivots in one of three directions which may be controlled by inserting a special key through the afore-mentioned prong holes. In one direction the contact points on the assembly contact hot power-the operable mode. In another direction they contact the neutral prong, i.e. the same power as the neutral prong-the inoperable mode. Finally, the assembly may be pivoted in a third direction which contacts a power source that is dependent on the condition of an external switch-the switched mode. The external switch may be on or off and thus the outlet may be on or off, operable or inoperable. While the hot prong recess in a normal power outlet is connected to a hot power source, in this invention the contact points on the hot prong are connected to the contacts on the pivoting assembly and thus the hot prong may be in one of three conditions corresponding to the three modes. The assembly maybe pivoted in each direction by use of a special key that fits through the recesses on the front of the outlet.

It is an object of the invention to provide a wall outlet power source which may function in one of three modes, normal, inoperable, or "switched" which means whether the outlet is hot or not depends on the condition of an external switch.

Another object of the invention is to provide a wall outlet power source whose power may be controlled by the condition of an external switch.

Yet another objective is to provide a series of wall outlets all of whose condition, hot or inoperable, may be controlled by an external switch.

Another objective is to provide a wall outlet whose power can be completely disabled by the user as needed.

Other objectives of the invention will become apparent to those skilled in the art once the invention has been shown and described.

DESCRIPTION OF THE PREFERRED EMBODIMENT

Figure 1:
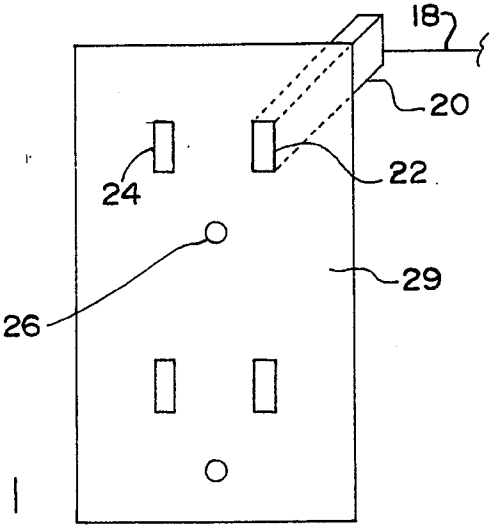
FIG. 1 Shows the front of the wall outlet

The switchable power outlet that is herein described has the standard two or three recesses found on the front plate 29 of most electrical power outlets. A two-prong outlet has two recesses, usually shaped as slots, these may be referred to as "prong holes." One prong hole 22 is the "hot" electrical power and the other 24, "neutral" electrical power. At lease negative with respect to the hot prong power supply. Some power outlets have a third recess, a circular hole 26 known as the ground hole to insure safety, among other things, for modern electrical appliances.

The switchable power outlet with the pivoting assembly for three modes may be used with two or three hole outlets. The key 40, see FIG. 4, that is used to enable these three modes is designed to be used with three hole (or recess) outlets.

Figure 5:
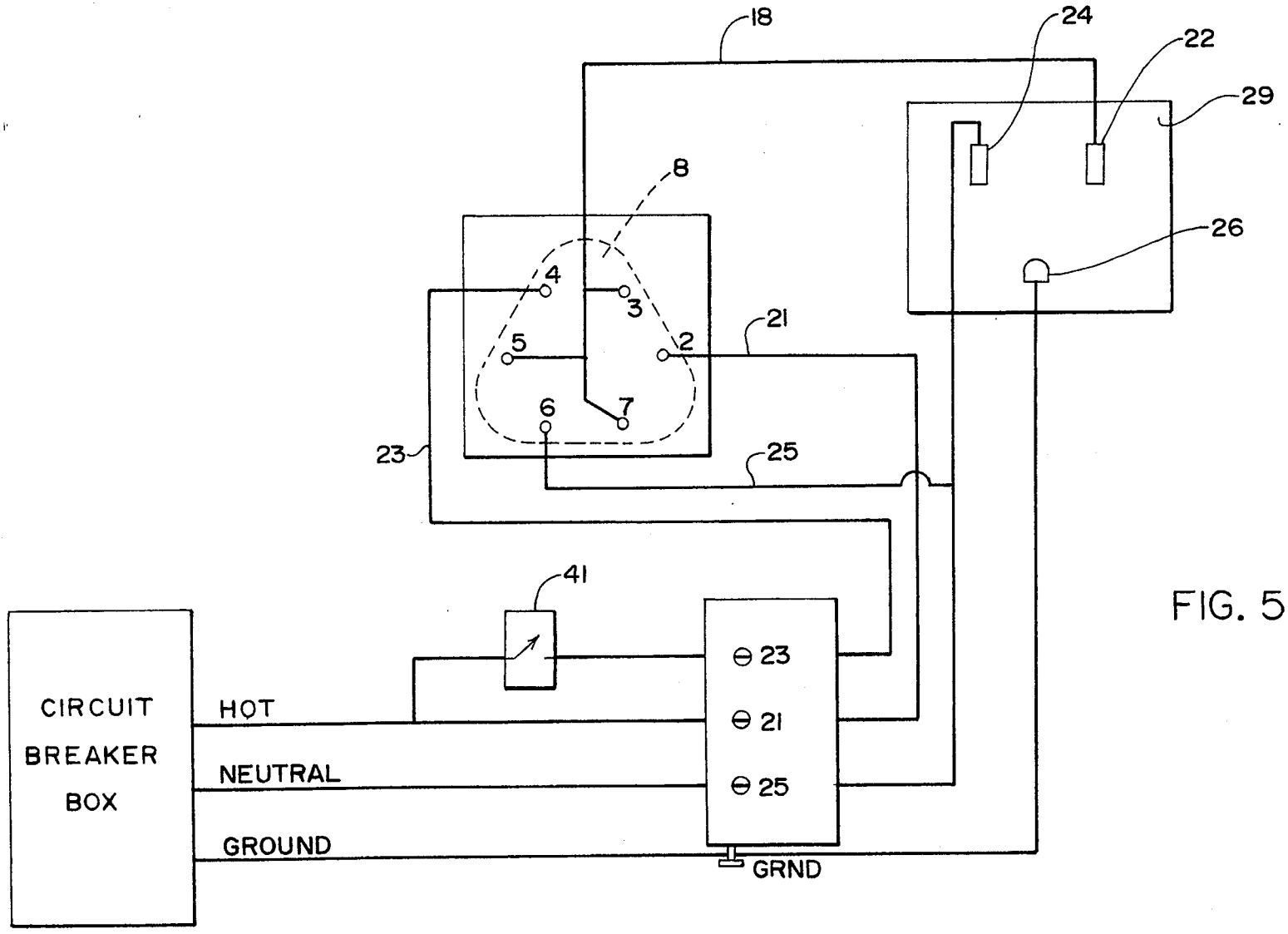
FIG. 5 Shows an overall electrical schematic of the system including the external switch and the power supplies.

By "hot" we refer to that prong normally in connection with a hot electrical power source usually e.g. 110 volt AC source in a normal household wiring scheme. By "neutral" we mean that outlet is negative voltage with respect to the hot power source, usually about 0 volts in a normal household supply. By "ground" the normal term for a power source that is grounded. By "switched" we mean that whether that power supply is negative or hot depends on the condition of an external switch 41, see FIG. 5, this may be on a wall or in some other place in the building.

If the external switch is on, then the power source is hot. If the switch is off the power source is neutral and thus the outlet is effectively inoperable, since when one plugs into the hot and neutral prong recesses the "hot" prong will be neutral (if switch is off) and thus the same as the "neutral" prong-thus no power will flow.

Figure 2:
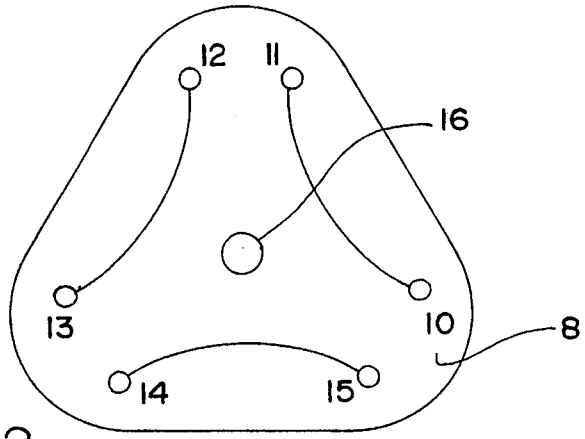
FIG. 2 Shows construction of switching disk
Figure 6:
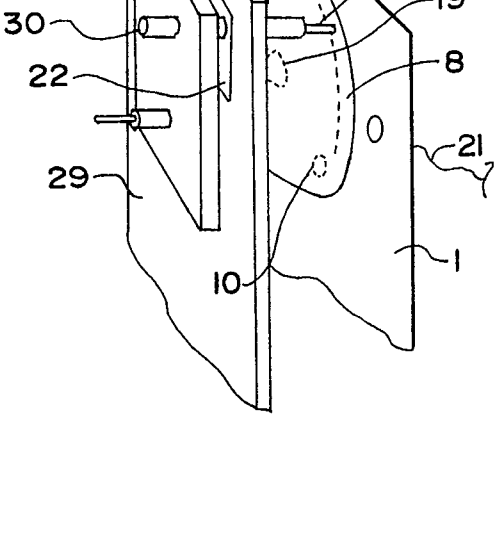
FIG. 6 Schematic.

The novel structure of the power outlet is a pivoting assembly see FIG. 2, located near the back of the outlet box. This assembly may be in the form of a triangular shaped disk 8. Each side of the disk has a contacting portion numbered 10, 11, 12, 13, 14 and 15. 10 and 11 designate the ends of one contact portion, 12 and 13 the ends of another portion and 14 and 15 the ends of another portion.

The contact portions should be made of conductive materials e.g. copper, etc. Each contact should be far enough away from the nearby, contacts so as not to interfere with the contacts of the other two sides. The disc 8 includes a cup 16 that rests on a central projection or pivot 19 extending from the back plate 1 which allows the disc 8 to pivot in one of three directions, each direction corresponds to one of the sides of the triangle and hence one of the three contact pairs. The disc pivots in the manner of a lever about a projection 19 which acts as a fulcrum.

The contact point 20 near the hot prong is connected by a wire 18 or other conductive means to backplate contacts 3, 5 and 7. Whenever one of the three sides on the disk comes in contact with the connections on the back plate 1, the appropriate connections are made so that supply will be sent to the hot contact 20.

Figure 3:
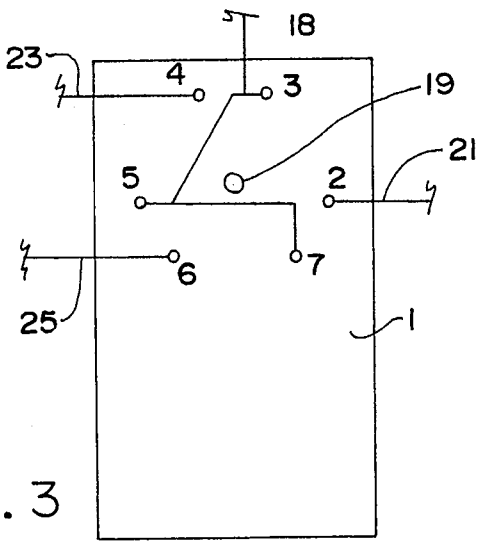
FIG. 3 Shows back of outlet box.

In close connection with the pivoting disk, and near the back wall 1 of the outlet box are six contact points in pairs, 2 and 3, 4 and 5, and 6 and 7. Three of these contact points are in connection with one of the three power sources-a hot source 21, the normal power source to the hot prong; a neutral power source 25, i.e. the same supply as that on the neutral prong and a "switched" electrical power source controlled by a switch 41. The other three contact points are joined to one another and to the hot prong by lead 18, see FIG. 3.

Each of the three contact pairs on the disk 8 may be pivoted to come in connection with one of the three power source contact pairs near the back of the outlet box. If the disk is pivoted to the upper right, say, one side of the triangle (contacts 10 and 11) will come in contact with the contact points 2 and 3 for the hot power source. That hot power will then be sent to the contact near the hot prong and the outlet will function normally.

If the disk 8 is pivoted downward, say, the neutral contact 6 will come in contact with contact 14 on the disk and contact 15 connects to contact 7 and neutral voltage will be on the hot prong. In that case, the hot prong will be effectively zero voltage with respect to the neutral prong and the outlet will be inoperable. Finally, if the disk is pivoted to the upper left, the switched power supply will be on the contact near the hot recess via the contacts 4, 12, 13 and 5 and whether the outlet is operable or inoperable will be dependent on the condition of an external switch 41 in connection with the switched power supply.

The assembly is spring loaded or otherwise constructed so that it is always in one of the three pivoted positions. The direction of movements are examples, the actual direction of the pivoting movement has nothing to do with which power source that corresponds to.

Figure 4:
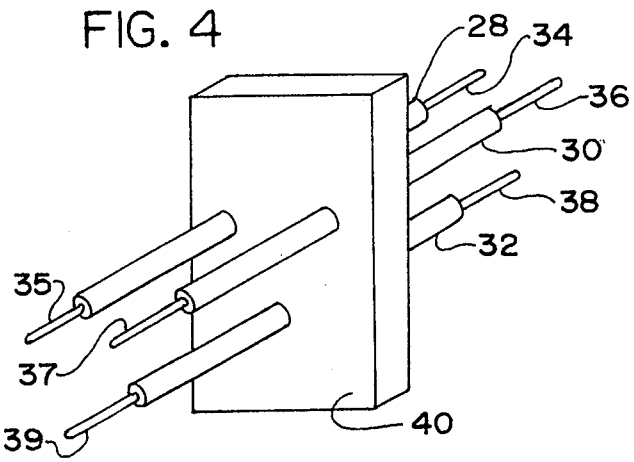
FIG. 4 Shows a switching plug that may be used in connection with the device.

To pivot the assembly to change modes a special key 40 may be inserted into the outlet holes, see FIG. 4. The key has prongs 28, 30 and 32 corresponding to each of the three outlet holes in normal wall outlets. Each prong has a rod 34, 36 and 38 which slides in each prong and may be slid by the user by depressing the outer portions of the rods 35, 37, 39. If one wants to place the outlet in normal mode, end 37 of rod 36 may be depressed, for example. This will pivot the triangular disk 8 to the upper right and the contacts 10 and 11 will make contact with the hot power contact 2 and contact 3 sending power to wire 18 and terminal 20. The other rods are used to pivot the assembly in the other directions. The rods should, of course, be non-conductive. They may also be spring loaded to return to their original position once the user has depressed one of them for switching modes.

Of course, the invention should not be construed as limited to only houses or buildings, but such a switchable power outlet may find utility in any place where electrical outlets are in use. The power outlet may be found on ceilings, floors, outside receptacles, machinery, etc. not merely on walls. The power supply should also not be construed as only applicable to 110 volt supplies, but rather all power supplies may find use for the applicant's invention.

I claim:

1. An electrical power outlet having three modes of operation comprising: outlet box having a neutral prong recess and a hot prong recess being, said neutral prong recess in connection with a neutral electrical power source, a hot power source having a hot terminal point near the back of said power outlet, a neutral power source having a neutral terminal point near the back of said outlet and a switched power source having a switched terminal point near the back of said power outlet, said hot prong recess having a hot prong contact point near the back of said recess, a means for contacting said hot prong contact point with one of each of said: hot terminal point, neutral terminal point and said switched terminal point, said switched power source in connection with an external switching means for supplying either no power or hot power depending on the condition of said external switch.

2. The apparatus of claim 1 wherein said enabling means comprises a triangular shaped disk, said disk located between said hot prong contact point and said back wall of said outlet, said disk fixed for pivoting movement in one of three directions, said disk having a peripheral contacting strip on each of said sides of said triangular shape, said contacting strips in close proximity to said hot terminal point, said neutral terminal point and said switched terminal point, so that said hot prong contact point may be connected to each of said hot power, no power and switched power supplies through the pivoting movement of said disk.

* * * * *